US010637171B1

(12) United States Patent
Campbell et al.

(10) Patent No.: US 10,637,171 B1
(45) Date of Patent: Apr. 28, 2020

(54) ELECTRICAL CONNECTOR

(71) Applicant: Aptiv Technologies Limited, St. Michael (BB)

(72) Inventors: Jeffrey S. Campbell, West Bloomfield, MI (US); Wesley W. Weber, Jr., Metamora, MI (US)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/354,599

(22) Filed: Mar. 15, 2019

(51) Int. Cl.
*H01R 12/89* (2011.01)
*H01R 12/79* (2011.01)
*H01R 12/78* (2011.01)

(52) U.S. Cl.
CPC ..... *H01R 12/89* (2013.01); *H01R 12/78* (2013.01); *H01R 12/79* (2013.01)

(58) Field of Classification Search
CPC ..... H01R 12/78; H01R 12/79; H01R 12/61; H01R 12/62
USPC ..... 439/492, 493, 495, 496, 499
See application file for complete search history.

(56) References Cited

U.S. PATENT DOCUMENTS 3,082,398 A * 3/1963 Valach ..... H01R 12/78 439/496
3,319,216 A * 5/1967 McCullough ..... H01R 12/87 439/493
3,825,878 A * 7/1974 Finger ..... H01R 12/62 439/493
3,941,448 A * 3/1976 Evans ..... H01R 12/79 439/493
4,634,195 A 1/1987 Shoemaker
4,802,866 A * 2/1989 Balzano ..... H01R 12/78 439/496
4,824,391 A 4/1989 Ii
5,102,346 A 4/1992 Soes
5,173,058 A 12/1992 Broeksteeg et al.
5,240,420 A * 8/1993 Roberts ..... H01R 12/714 439/493
5,306,160 A * 4/1994 Roberts ..... H01R 12/714 439/493
5,691,041 A 11/1997 Frankeny et al.
5,954,536 A * 9/1999 Fuerst ..... H01R 12/79 439/493
6,017,244 A * 1/2000 Daane ..... H01R 12/61 439/495

(Continued)

*Primary Examiner* — Ross N Gushi
(74) *Attorney, Agent, or Firm* — Robert J. Myers

(57) ABSTRACT

An electrical connector includes a housing that is configured to receive a planar first substrate having an electrically conductive first circuit trace with a first contact region, such a flat cable. The housing is further configured to receive a planar second substrate having an electrically conductive second circuit trace with a second contact region, such as a printed circuit board or another flat cable. The housing is configured to align the first contact region with the second contact region. The connector also includes a force application device configured to apply a compressive contact force to the first and second substrates, thereby putting the first contact region in intimate compressive contact with the second contact region. The connector may also include an moveable actuating member that is configured to selectively increase the compressive contact force applied to the first and second substrates via interaction with the force application device.

34 Claims, 10 Drawing Sheets

(56) References Cited

U.S. PATENT DOCUMENTS 6,039,600 A * 3/2000 Etters ..... H01R 12/592 439/496
6,077,124 A * 6/2000 Etters ..... H01R 12/592 439/632
6,086,412 A * 7/2000 Watt ..... H01R 12/87 439/496
6,247,951 B1 * 6/2001 Di Liello ..... H01R 12/61 439/329
6,261,116 B1 7/2001 Ceru
6,478,597 B1 11/2002 Roberts et al.
6,558,186 B1 * 5/2003 LePottier ..... H01R 12/79 439/493
6,749,459 B2 * 6/2004 Urbaniak ..... H01R 12/78 439/496
6,780,046 B2 * 8/2004 Bach ..... H01R 12/61 439/495
6,881,085 B2 * 4/2005 Yahiro ..... H01R 12/721 439/326
6,932,642 B2 8/2005 Beer et al.
7,025,626 B2 * 4/2006 Fuerst ..... H01R 12/78 439/496
7,131,861 B2 * 11/2006 Aeschbacher ..... H01R 12/78 439/495
7,144,256 B2 12/2006 Pabst et al.
7,172,455 B2 * 2/2007 Pabst ..... H01R 12/78 439/496
7,232,334 B2 * 6/2007 Shimizu ..... H01R 12/592 439/493
8,625,302 B2 * 1/2014 Chu ..... G04G 17/04 361/679.41
9,166,320 B1 * 10/2015 Herring ..... H01R 12/79
2003/0232533 A1 * 12/2003 Burmeister ..... H01R 12/721 439/259
2008/0045076 A1 2/2008 Dittmann et al.

* cited by examiner

ELECTRICAL CONNECTOR

TECHNICAL FIELD OF THE INVENTION

The invention generally relates to an electrical connector, particularly to an electrical connector configured to electrically interconnect a flat cable.

BRIEF SUMMARY OF THE INVENTION

The present invention will now be described, by way of example with reference to the accompanying drawings, in which:

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
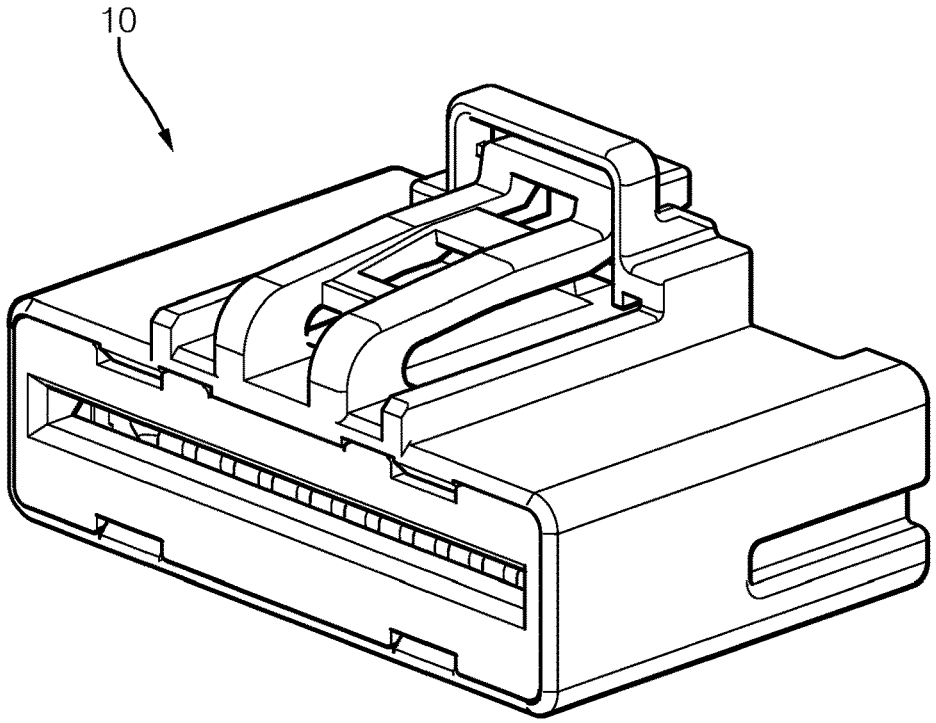
FIG. 1 is a perspective view of an electrical connector according to one embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

According to one embodiment of the invention, an electrical connector is provided. The electrical connector includes a housing that is configured to receive a planar first substrate including an electrically conductive first circuit trace having a first contact region. The housing is further configured to receive a planar second substrate including an electrically conductive second circuit trace having a second contact region. The housing is configured to align the first contact region with the second contact region. The electrical connector also includes a force application device that is configured to apply a compressive contact force to the first and second substrates, thereby putting the first contact region in intimate compressive contact with the second contact region.

In some embodiments of the invention, the electrical connector may further include an actuating member that is configured to increase the compressive contact force applied to the first and second substrates via interaction with the force application device. The actuating member is moveable from a pre-staged position in which the actuating member does not increase the compressive contact force to a staged position in which the actuating member increases the compressive contact force.

In some embodiments of the invention, the actuating member may be sized such that the increase in the compressive contact force is within a predetermined range regardless of an overall thickness of the first substrate and the second substrate.

In some embodiments of the invention, the compressive contact force is provided only by the force application device.

In some embodiments of the invention, the force application device is disposed within the housing.

In some embodiments of the invention, the force application device may have an open box-like structure that is configured to surround the first substrate and the second substrate.

In some embodiments of the invention, the force application device is formed of a metallic material and the housing is formed of a polymeric material.

In some embodiments of the invention, the compressive contact force comprises a first compressive contact force and a second compressive contact force in opposition to the first compressive contact force. The force application device may include a first spring member that is configured to apply the first compressive contact force to the first substrate and a second spring member configured to apply the second compressive contact force to the second substrate.

In some embodiments of the invention, the actuating member is not located intermediate the first spring member and the second spring member in the pre-staged position and the actuating member is located intermediate the first spring member and the second spring member in the staged position. The actuating member may be configured to apply the second compressive contact force to the actuating member when in the staged position, thereby applying the second compressive contact force to the second substrate.

In some embodiments of the invention, the actuating member is integral with a connector position assurance device that is configured to allow movement of the actuating member from the pre-staged position to the staged position when the housing is received within and fully mated with a corresponding mating connector.

In some embodiments of the invention, the actuating member may be sized such that the second compressive contact force is within a predetermined range regardless of an overall thickness of the first substrate and the second substrate.

In some embodiments of the invention, the second spring member is located opposite the first spring member.

In some embodiments of the invention, the first spring member and the second spring member are integrally formed within the force application device.

In some embodiments of the invention, the first spring member is an arcuate first fixed beam having a first radius of curvature and the second spring member is an arcuate second fixed beam having a second radius of curvature and wherein the first radius of curvature is less than the second radius of curvature.

In some embodiments of the invention, the electrical connector includes the first substrate which is formed of a flexible material and a planar stiffening member attached to a surface of the first substrate located opposite the first contact region.

In some embodiments of the invention, the stiffening member defines an opening through the stiffening member in which the first spring member is received and through which the first spring member makes contact with the surface of the first substrate located opposite the first contact region.

In some embodiments of the invention, the stiffening member is disposed within and is attached to the housing by a latching mechanism.

In some embodiments of the invention, a rearward edge of the stiffening member defines a ridge configured to contact the housing and positions the first contact region within the housing.

In some embodiments of the invention, a forward edge of the stiffening member defines an angled lip having a maximum height at least equal to a thickness of the first substrate.

In another embodiment of the invention, an electrical connector is provided. The electrical connector includes a housing that is configured to receive a planar first substrate including an electrically conductive first circuit trace having a first contact region in a cavity defined within the housing. The housing is further configured to receive a planar second substrate including an electrically conductive second circuit trace having a second contact region in the cavity. The first contact region is configured to be aligned with the second contact region. The electrical connector also includes a force application device having a first spring member configured to apply a first compressive contact force to the first substrate and having a second spring member configured to apply the second compressive contact force to the second substrate, thereby putting the first contact region in intimate compressive contact with the second contact region.

In some embodiments of the invention, the electrical connector may further include an actuating member configured to increase the compressive contact force applied to the first and second substrates via interaction with the force application device. The actuating member is configured to be moveable from a pre-staged position in which the actuating member is not located intermediate the first spring member and the first substrate to a staged position in which in which the actuating member is located intermediate the first spring member, thereby applying the first compressive contact force to the first substrate.

In some embodiments of the invention, the actuating member is configured to increase the second compressive contact force applied by the second spring member to the second substrate when the actuating member is in the staged position.

In some embodiments of the invention, the actuating member is sized such that the second compressive contact force applied to the second substrate is within a predetermined range regardless of an overall thickness of the first substrate and the second substrate.

In some embodiments of the invention, the actuating member is sized such that the first compressive contact force applied to the first substrate is within a predetermined range when the actuating member is in the staged position regardless of an overall thickness of the first substrate and the second substrate.

In some embodiments of the invention, the first and second compressive contact forces are provided only by the force application device.

In some embodiments of the invention, the force application device has an open box-like structure that is configured to surround the first substrate and the second substrate.

In some embodiments of the invention, the electrical connector also includes the first substrate. The first substrate may be formed of a flexible material. The electrical connector additionally includes a planar stiffening member that is attached to a surface of the first substrate located opposite the first contact region.

According to yet another embodiment of the invention, a stiffening member configured for attachment to flat flexible electrical cable formed of a flexible planar substrate including an electrically conductive circuit trace having an exposed contact region is provided. The stiffening member includes a planar body portion and an opening through the body portion configured to allow access to a surface of the substrate opposite the contact region.

In some embodiments of the invention, the stiffening member also includes an angled lip on a forward edge of the stiffening member having a maximum height at least equal to a thickness of the substrate.

In some embodiments of the invention, the stiffening member is configured to be disposed within and is attached to a housing of an electrical connector.

In some embodiments of the invention, the stiffening member additionally includes a locking latch configured to engage a strike surface within the housing and retain the stiffening member within the housing.

In some embodiments of the invention, the stiffening member further includes a rearward edge of the stiffening member defines a ridge configured to contact a rearward surface of the housing of the electrical connector, thereby positioning the contact region within the housing.

According to one more embodiment of the invention, a printed circuit board assembly is provided. The printed circuit board assembly includes a circuit board substrate and a circuit board trace having a circuit board contact region configured to be in intimate contact with a cable contact region of a cable circuit trace contained in flat cable. The circuit board contact region defines a plurality of ridges protruding from a circuit board substrate surface.

In some embodiments of the invention, the plurality of ridges is formed on outer edges of a plurality of plated through holes in the circuit board contact region. The plurality of plated through holes may be arranged linearly in the circuit board contact region.

In some embodiments of the invention, the plurality of ridges is formed by a serpentine pattern in the circuit board trace within the circuit board contact region.

In some embodiments of the invention, the printed circuit board assembly also includes a connector housing surrounding the circuit board contact region. The connector housing is configured to receive a mating connector attached to the flat cable.

Figure 2:
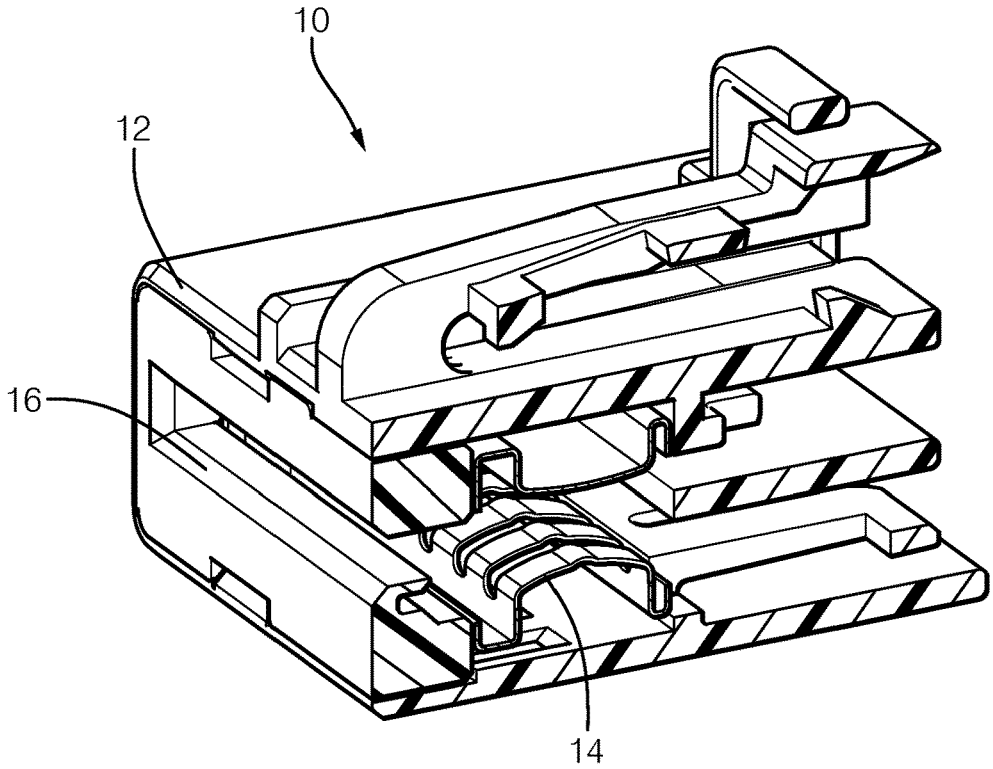
FIG. 2 is a perspective cross section view of the electrical connector of FIG. 1 according to one embodiment of the invention.
Figure 3:
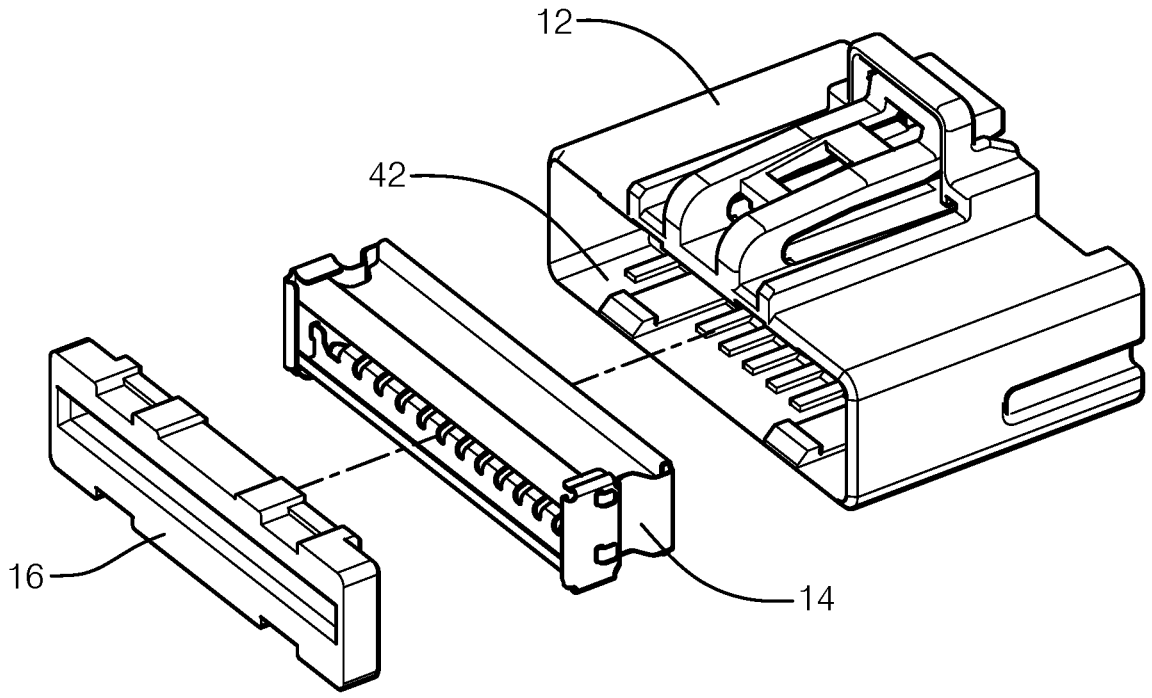
FIG. 3 is a perspective exploded view of the electrical connector of FIG. 1 according to one embodiment of the invention.
Figure 4:
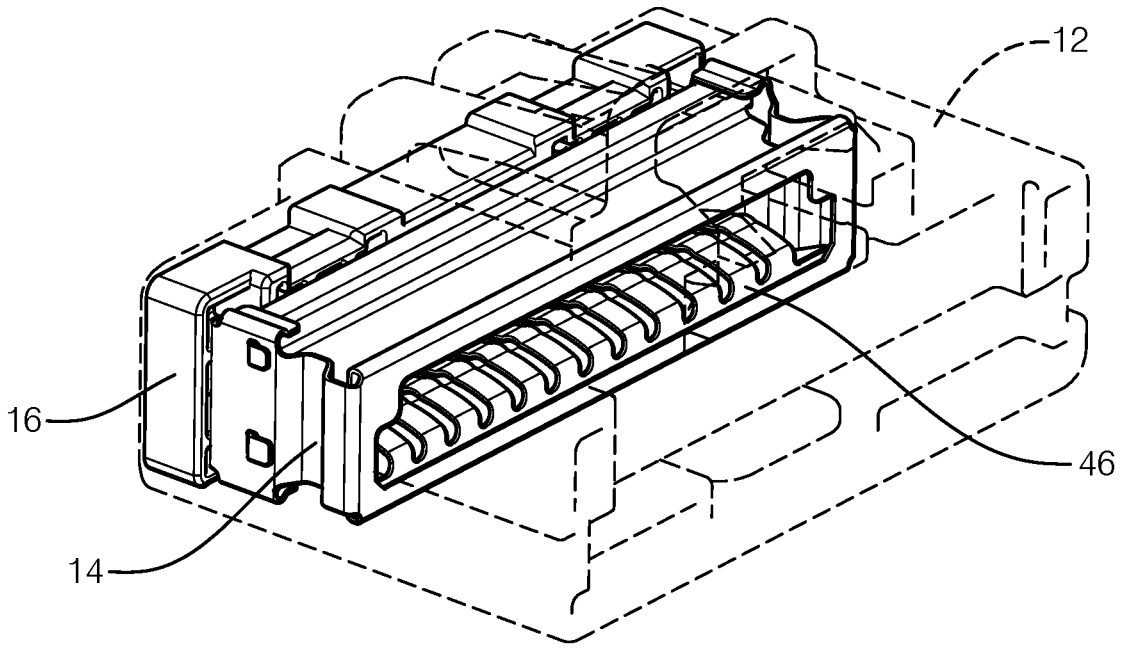
FIG. 4 is a perspective cut away view of the electrical connector of FIG. 1 according to one embodiment of the invention.

FIGS. 1-19 illustrate a non-limiting example of an electrical connector according to one or more embodiments of the invention. As best illustrated in FIG. 3, the electrical connector, hereinafter referred to as the connector 10, includes a housing 12, a force application device, hereinafter referred to as the spring array 14, and a retainer 16 that is configured to secure the spring array 14 within the housing 12.

Figure 8:
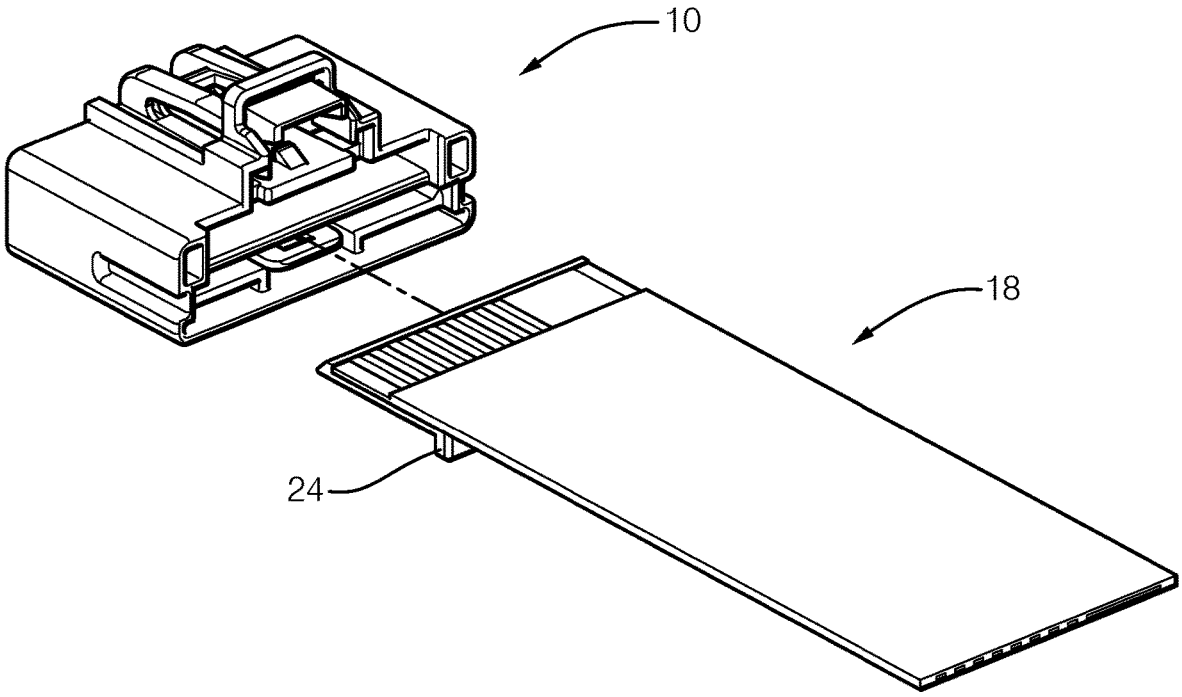
FIG. 8 is a perspective exploded view of the flat cable of FIG. 5 prior to insertion in the electrical connector of FIG. 1 according to one embodiment of the invention.
Figure 9:
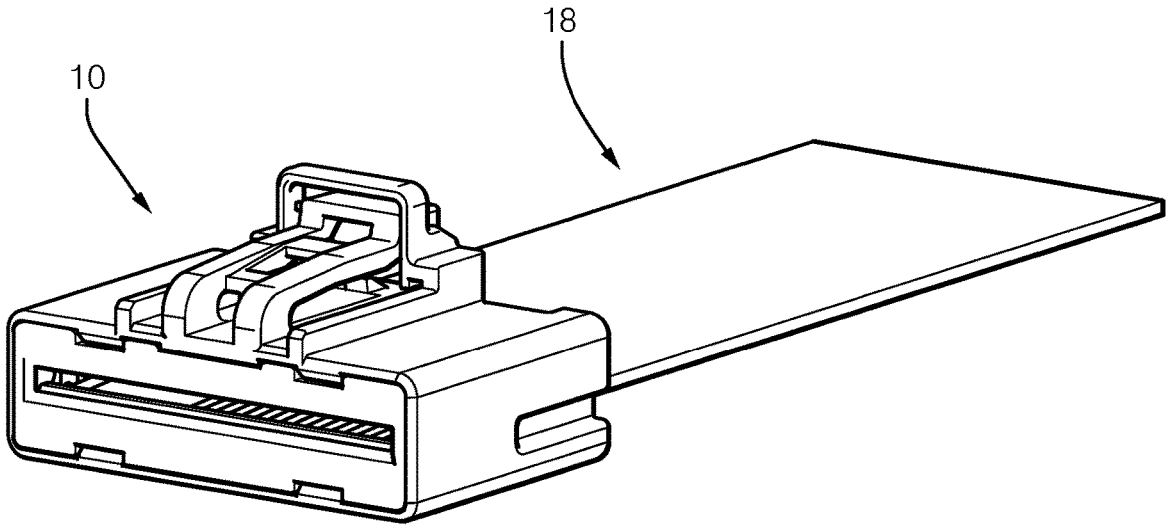
FIG. 9 is a perspective view of an assembly of the flat cable of FIG. 5 with the electrical connector of FIG. 1 according to one embodiment of the invention.
Figure 10:
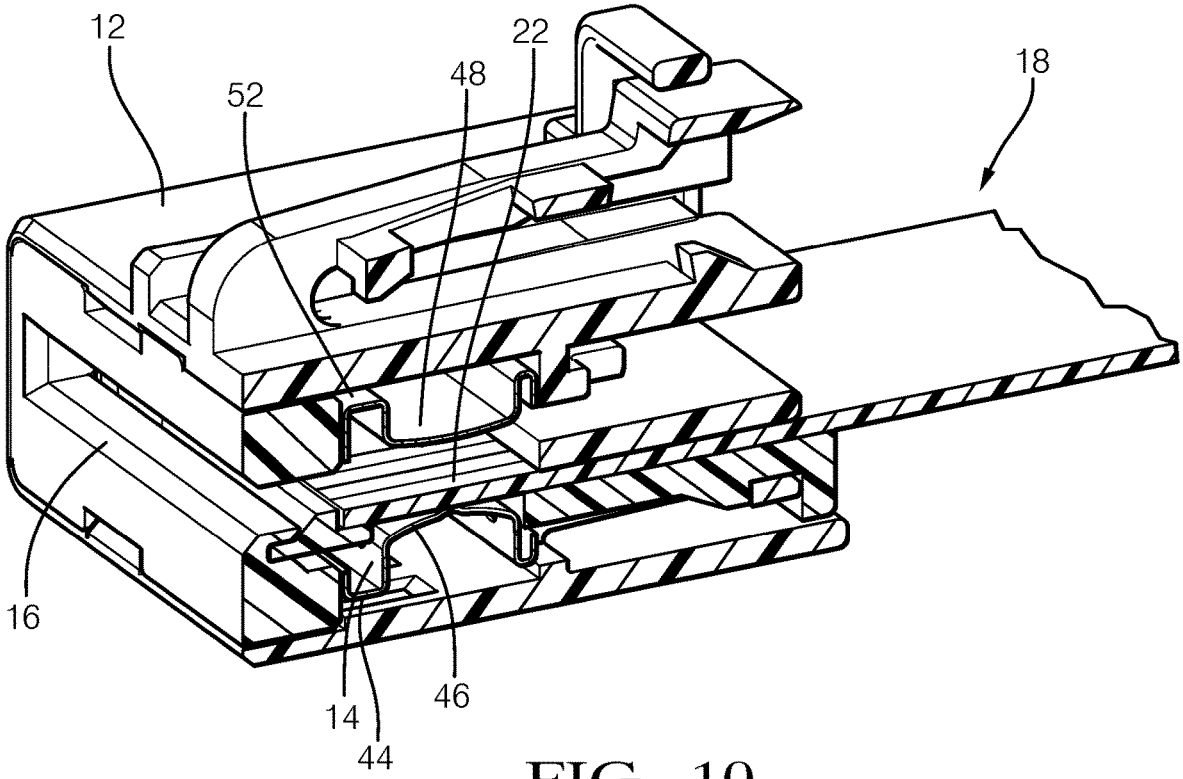
FIG. 10 is a perspective cross section view of the assembly of FIG. 9 according to one embodiment of the invention.

The connector 10 is configured to receive a planar first substrate, in this particular non-limiting example a flat cable 18, as best shown in FIGS. 8 and 9. The flat cable 18 includes a plurality of electrically conductive circuit traces (not shown), each having an exposed first contact region 22. The flat cable 18 also includes a stiffening member 24 that is attached to the flat cable 18 opposite the first contact regions 22.

Figure 15:
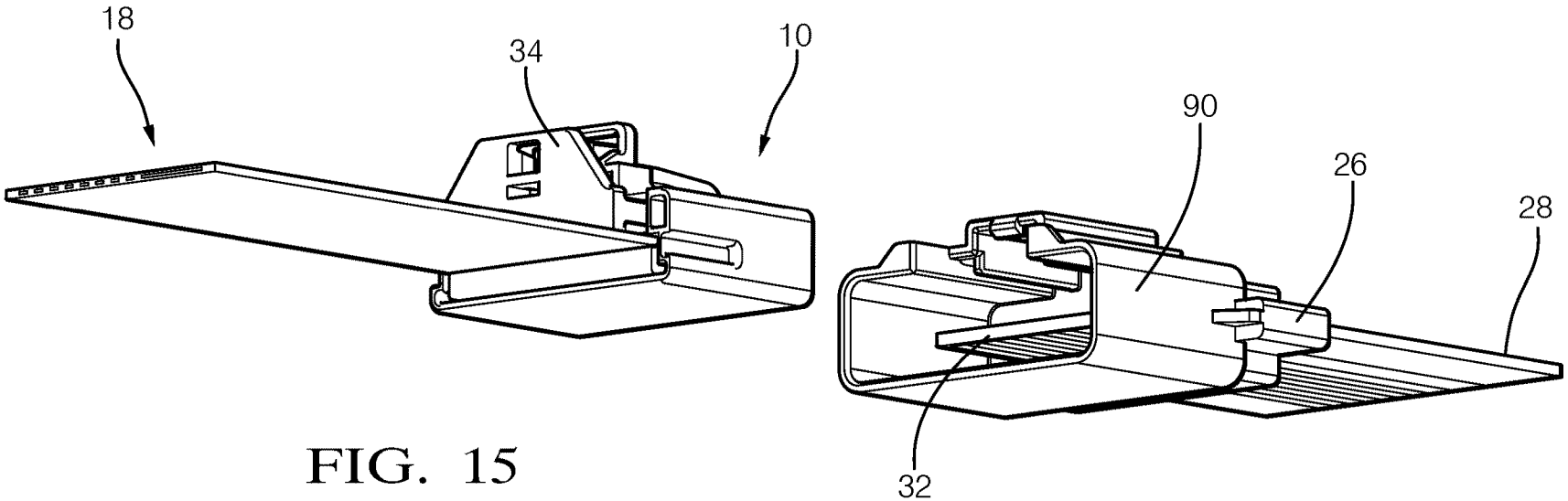
FIG. 15 is a perspective view of the assembly of FIG. 13 and a printed circuit board including a corresponding mating electrical connector according to one embodiment of the invention.
Figure 16:
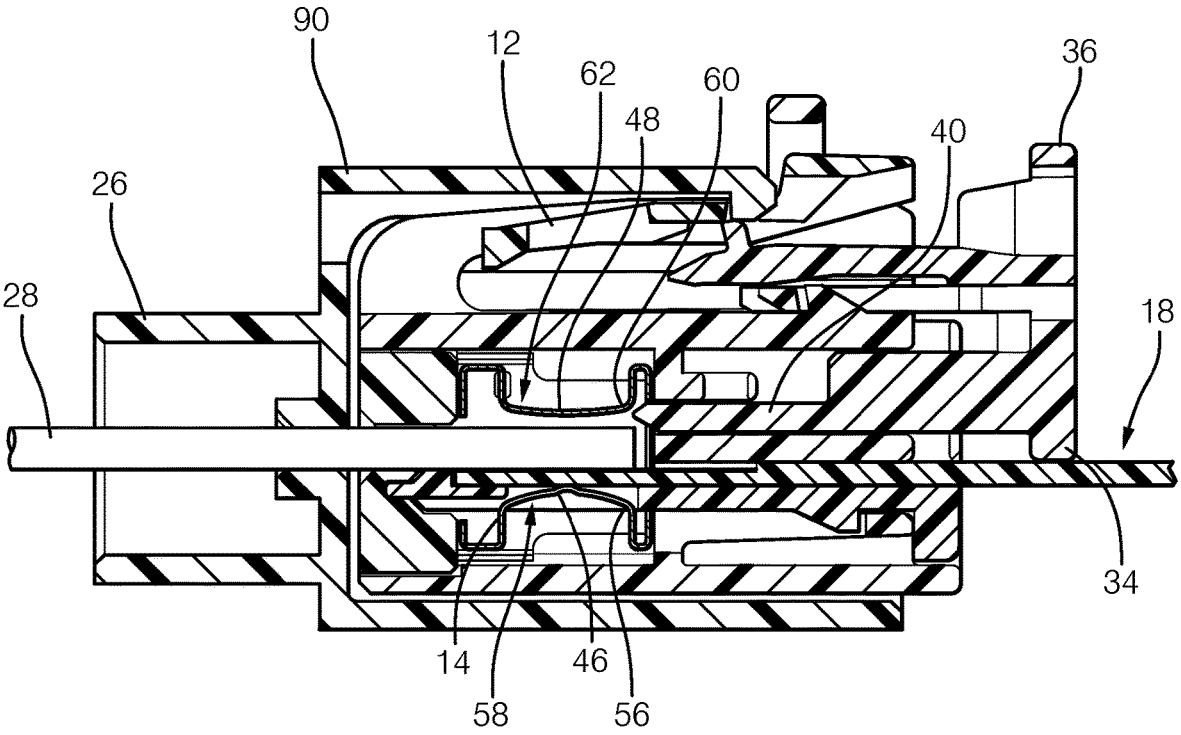
FIG. 16 is a cut away side view of the assembly of FIG. 13 interconnected with the printed circuit board of FIG. 15 having the connector position assurance device in the pre-staged position according to one embodiment of the invention.

The connector 10 and flat cable 18 are configured to be received within a corresponding mating connector 26 attached to a planar second substrate, in this particular non-limiting example a printed circuit board (PCB) 28, as best shown in FIGS. 15 and 16. The PCB 28 may be a component of an electronic controller (not shown) connected to the flat cable 18. The PCB 28 includes a plurality of electrically conductive second circuit traces 30, each having a second contact region 32. When the flat cable 18 and the PCB 28 are received within the connector 10, the housing 12 is configured to align the first contact regions 22 with the second contact regions 32. Once the connector 10 is mated with the mating connector 26, the spring array 14 is configured to apply a compressive contact force to the flat cable 18 and the PCB 28, thereby putting the first contact regions 22 in intimate compressive contact with the second contact regions 32.

Figure 17:
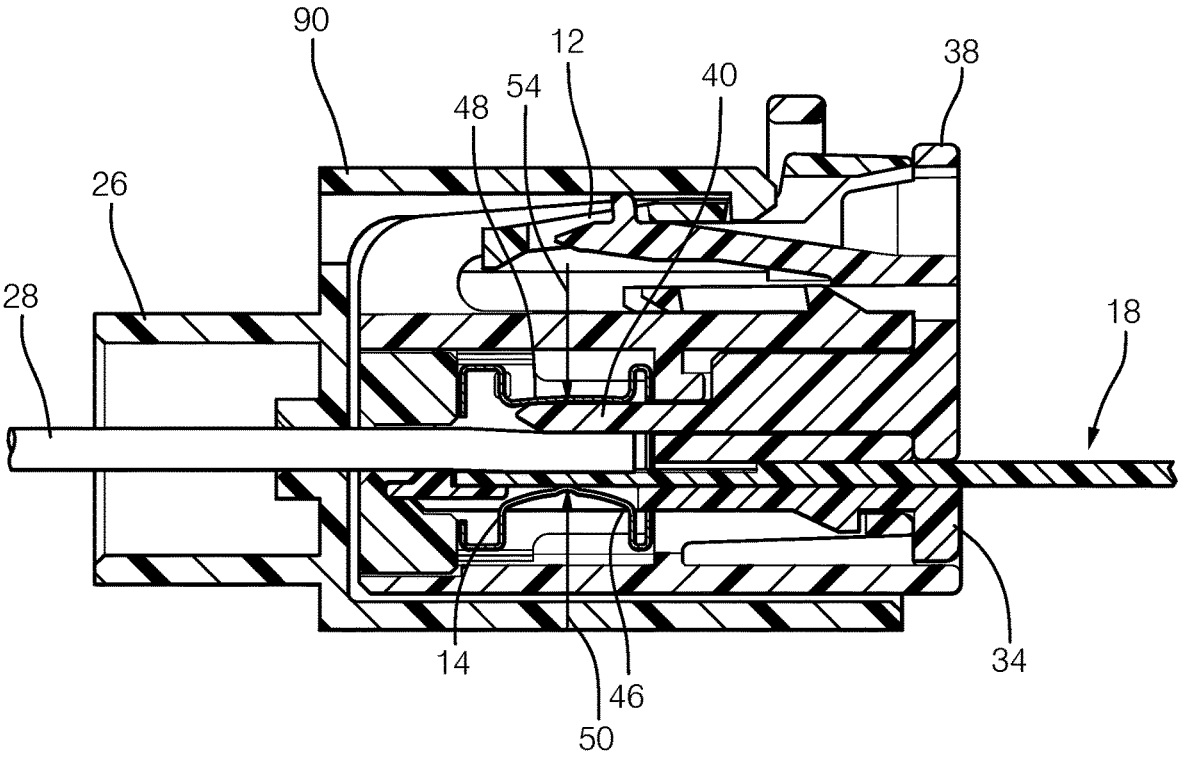
FIG. 17 is a cut away side view of the assembly of FIG. 13 interconnected with the printed circuit board of FIG. 15 having the connector position assurance device in the staged position according to one embodiment of the invention.

As best illustrated in FIGS. 12-17, the connector 10 also includes a connector position assurance (CPA) device 34 that is moveable from a pre-staged position 36 shown in FIG. 16 to a staged position 38 shown in FIG. 17. The CPA device 34 also includes an actuating member 40 that is configured to increase the compressive contact force applied to the flat cable 18 and the PCB 28 via interaction with the spring array 14.

Focusing now on the connector 10, the housing 12 and the retainer 16 are formed of a dielectric material, e.g. polyamide (PA, also known as nylon), polybutylene terephthalate (PBT), or another engineered polymer. As best shown in FIG. 2, the housing 12 defines a cavity 42 extending therethrough in which the spring array 14, the flat cable 18 and the PCB 28 are received. The spring array 14 is secured within the cavity 42 by latching features on the retainer 16 interfacing with corresponding features defined within the cavity 42.

Figure 11:
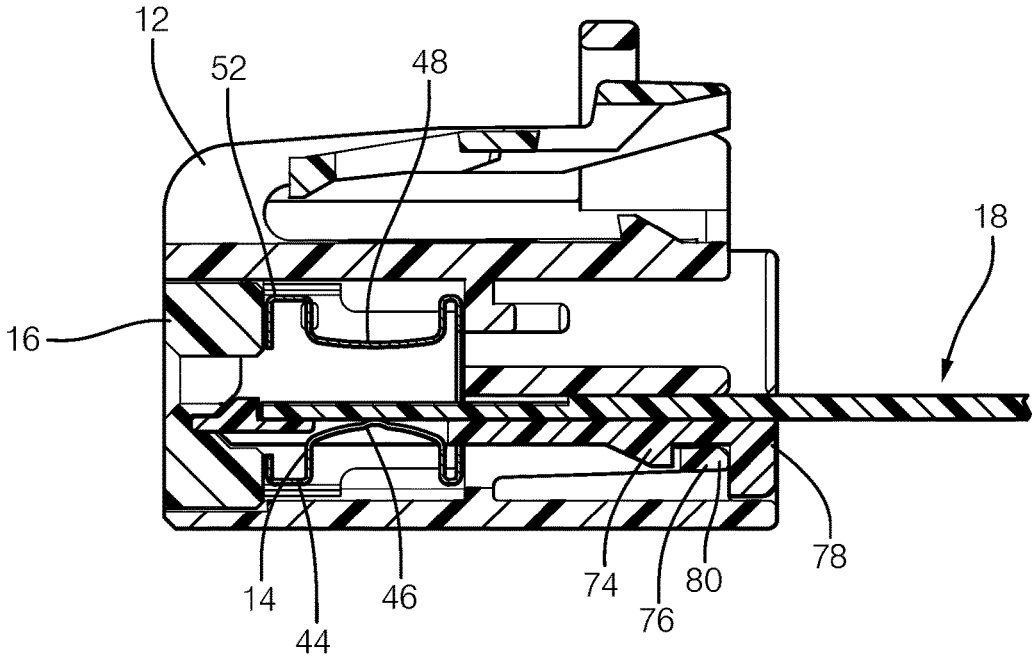
FIG. 11 is a side cross section view of the assembly of FIG. 9 according to one embodiment of the invention.

In the non-limiting example shown in FIG. 3, the spring array 14 has an open box shape that is formed by stamping and folding sheet metal, e.g. stainless steel, into the open box shape that surrounds the junction between the flat cable 18 and the PCB 28 when the connector 10 and the mating connector 26 are fully mated. As shown in FIG. 11, the bottom surface 44 of the spring array 14 defines a plurality of first spring members, hereinafter referred to as bottom spring members 46, that are integrally formed with the spring array 14 and are configured to apply a first component 50 of the compressive contact force to the flat cable 18. The top surface 52 opposite the bottom surface 44 defines a second spring member, hereinafter referred to as the top spring member 48, that is also integrally formed with the spring array 14 and is configured to apply a second component 54 of the compressive contact force to the PCB 28. The bottom spring members 46 are arranged such that they contact the flat cable 18 in locations opposite each of the first contact regions 22. This provides the benefit of providing the first component 50 of the compressive spring force to each of the first contact regions 22. The top spring member 48 may be a single spring member or may include a plurality of spring members.

As shown in FIG. 16, the bottom spring members 46 are in direct contact with the flat cable 18 while the top spring member 48 is not in contact with the PCB 28. Therefore, the second component 54 of the compressive contact force is applied to the PCB 28 by the actuating member 40 which is located intermediate the top spring member 48 and the PCB 28 and in mechanical contact with both the top spring member 48 and the PCB 28 when in the staged position 38 as shown in FIG. 17.

The open box shape of the spring array 14 is configured such that the compressive contact forces 50, 52 applied to the flat cable 18 and PCB 28 are supplied solely by the spring array 14. The spring array 14 is free floating within the housing 12 such that the housing 12 does not provide any of the compressive contact force to the flat cable 18 or the PCB 28. The inventors have found that the open sheet metal box of the spring array 14 diminishes a reduction in compressive contact forces 50, 52 that may occur over time or with exposure to elevated temperatures, e.g. temperatures exceeding 85° C. due to relaxation when a polymeric element, such as the housing 12, provides all or a portion of the compressive contact forces 50, 54.

As best shown in FIG. 16, the bottom spring members 46 each have an arcuate fixed beam portion 56 with a first radius of curvature 58 and the top spring member 48 each have an arcuate fixed beam portion 60 having a second radius of curvature 62. As can be seen in FIG. 16, the first radius of curvature 58 of the bottom spring members 46 is less than the second radius of curvature 62 of the top spring member 48. This difference in the radii of curvature 58, 62 provides two separate benefits. The shorter radius of the first curvature 58 of the bottom spring members 46 forms an apex that causes a smaller contact patch between each bottom spring member 46 and the flat cable 18, thereby increasing a contact pressure applied between the first contact region and the second contact region 32. The longer second radius of curvature 62 of the top spring member 48 provides a smaller deviation between an initial insertion force and a peak insertion force as the actuating member 40 is moved from the pre-staged position 36 to the staged position 38 and is inserted between the top spring member 48 and the PCB 28. The spring array 14 is not an electrical current carrying member of the connector 10. Therefore, the material choice for the material used to form the spring array 14 may be based on the mechanical properties of the material without any regard to the electrical properties.

Alternative embodiments of the connector may not include an actuating member and in these embodiments the top spring member may be in direct contact with the PCB. In these embodiments it may be preferred to have an electrically insulative surface of the PCB in contact with the top spring member or to have an electrical insulative member between the top spring member and the PCB to avoid electrical short circuiting of conductive traces on the PCB. Additionally, alternative embodiments of the connector may include top and bottom spring members that are cantilevered springs, coil springs, elliptical springs, or other types of compression springs. In applications where polymeric creep or relaxation are not a design factor, the spring array may be formed of a polymeric material since the spring array is not a current carrying member and or may not be a separate open box design but may be integrated into the housing.

Figure 12:
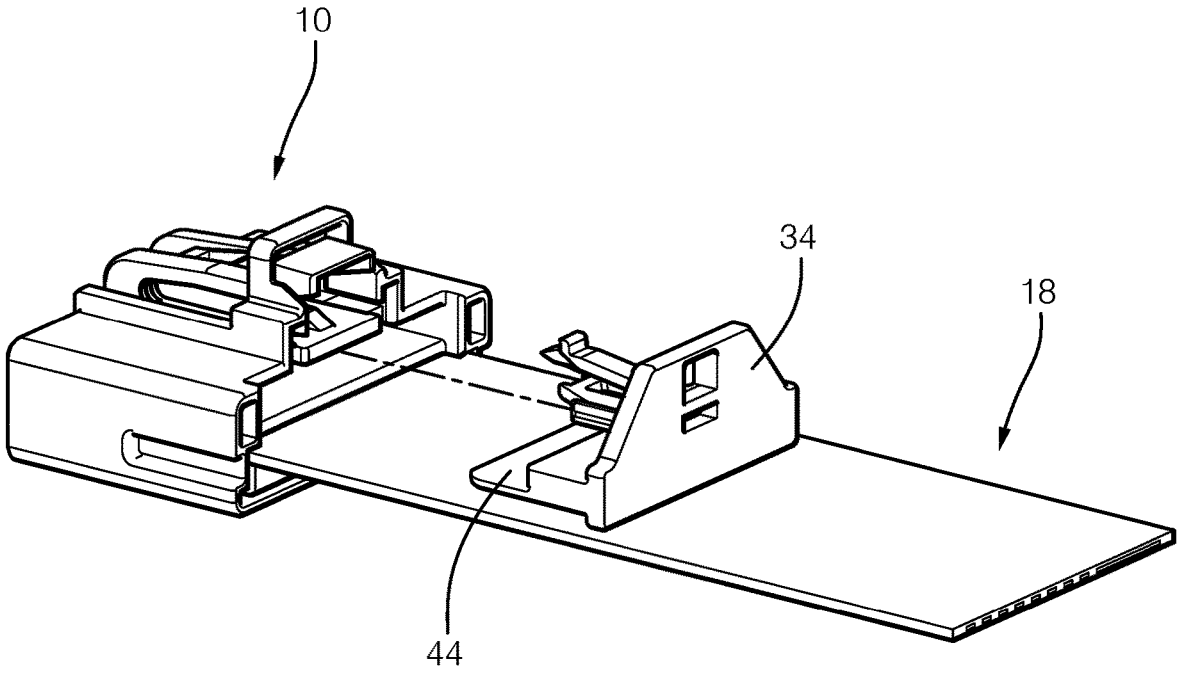
FIG. 12 is a perspective exploded view of a connector position assurance device including an actuating member prior to insertion in the assembly of FIG. 9 according to one embodiment of the invention.

A best shown in FIG. 12, the actuating member 40 is a planar member that is integral with the CPA device 34. The CPA device 34 is formed of a dielectric material, such as PA or PBT. The CPA device 34 is slideably attached to the housing 12 and is configured to ensure that the connector 10 is fully mated with the mating connector 26. The CPA device 34 is designed such that it may not be moved from the pre-staged position 36 to the staged position 38 until the connector 10 is fully mated with the mating connector 26. The design and operation of CPA devices for electrical connectors are well known to those having ordinary skill in the art. The thickness of the actuating member 40 is sized such that the second component 54 of the compressive contact force is within a predetermined range regardless of an overall thickness of the flat cable 18 and the PCB 28. In alternative embodiments, the actuating member may include a plurality of individual fingers aligned with the second contact regions rather than a single planar member.

Figure 5:
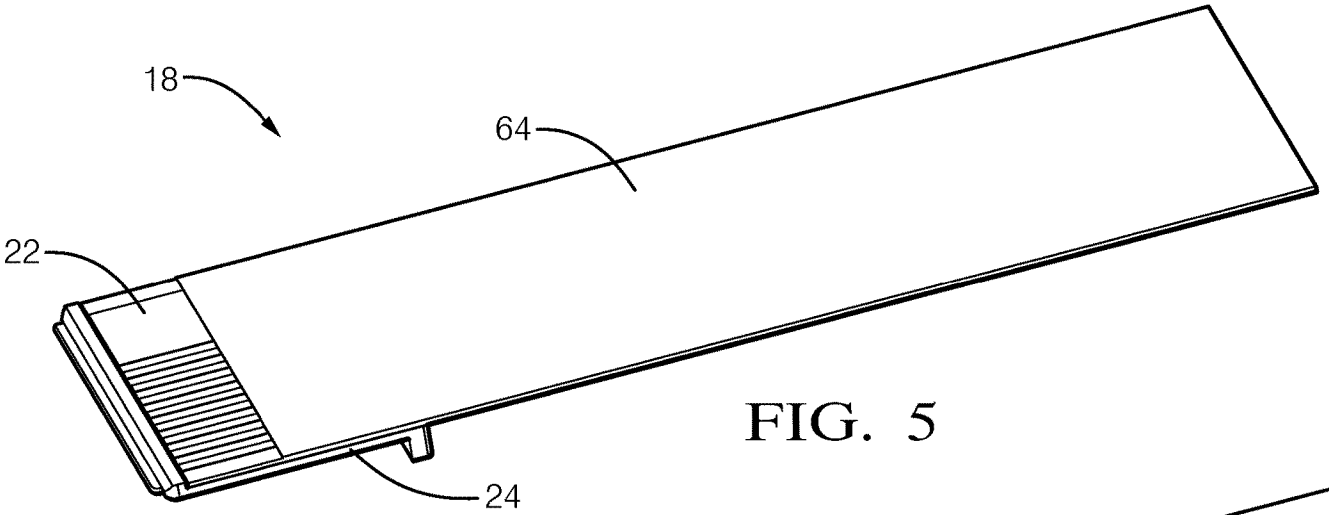
FIG. 5 is a perspective view of a flat cable used with the electrical connector assembly of FIG. 1 according to one embodiment of the invention.
Figure 6:
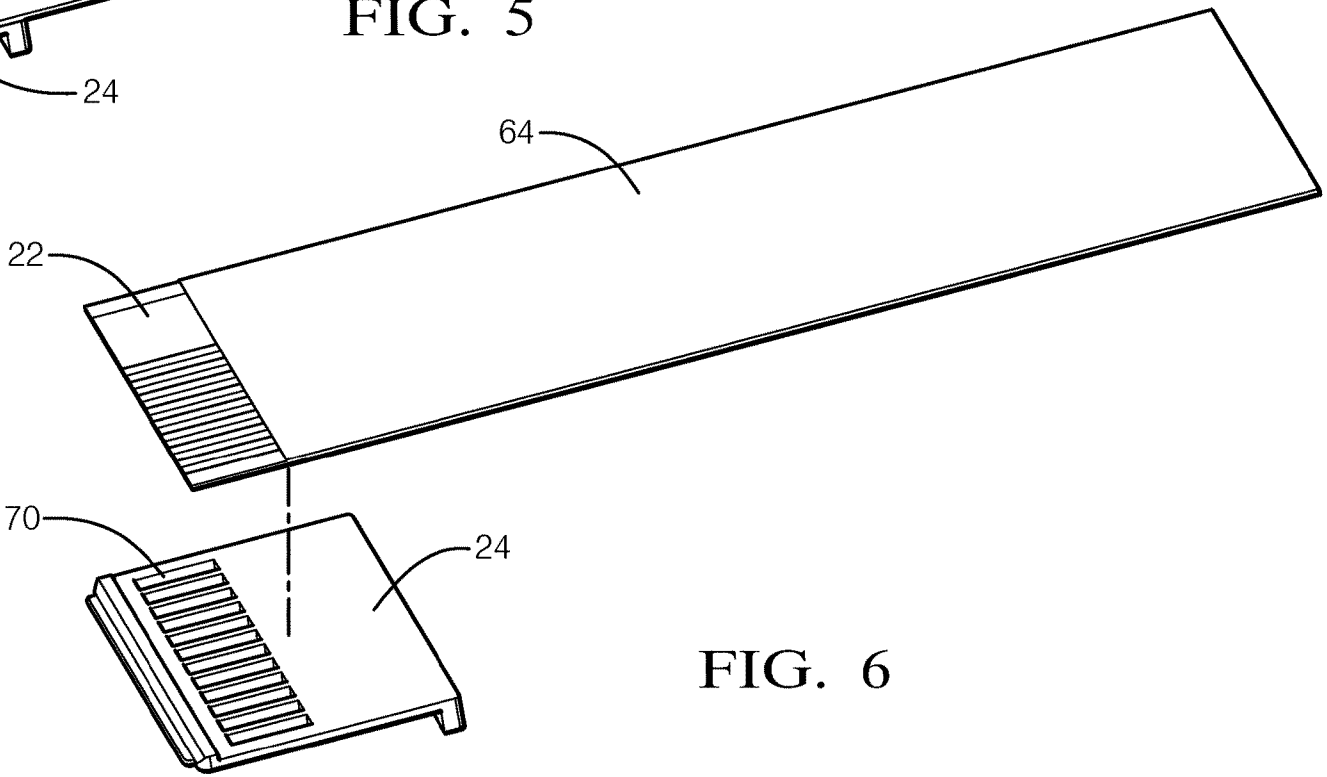
FIG. 6 is an exploded perspective view of the flat cable used of FIG. 5 according to one embodiment of the invention.
Figure 7A:
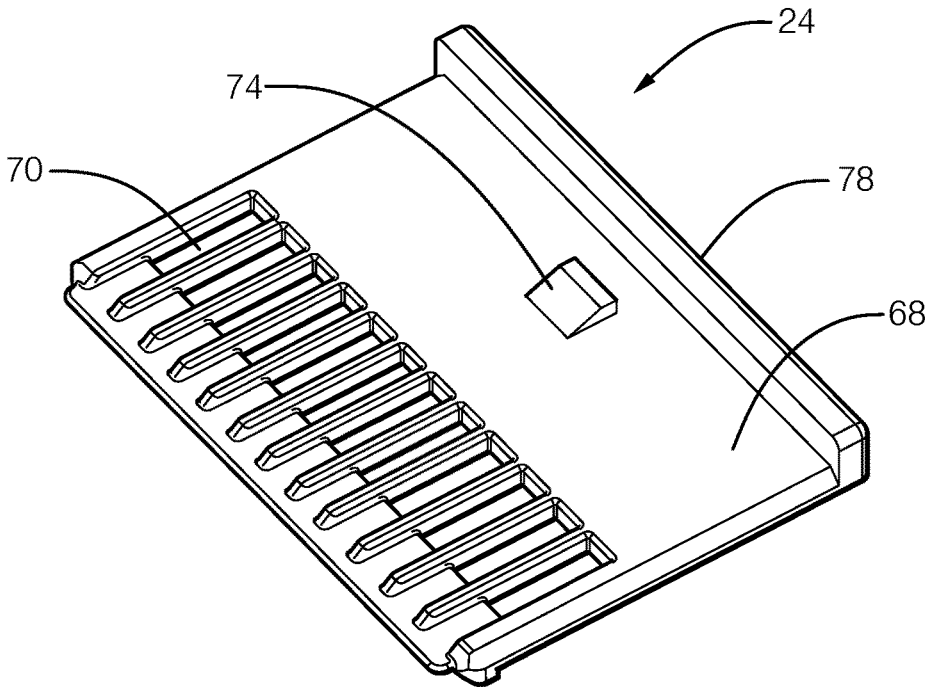
FIG. 7A is a perspective top view of stiffening member of the flat cable of FIG. 5 according to one embodiment of the invention.
Figure 7B:
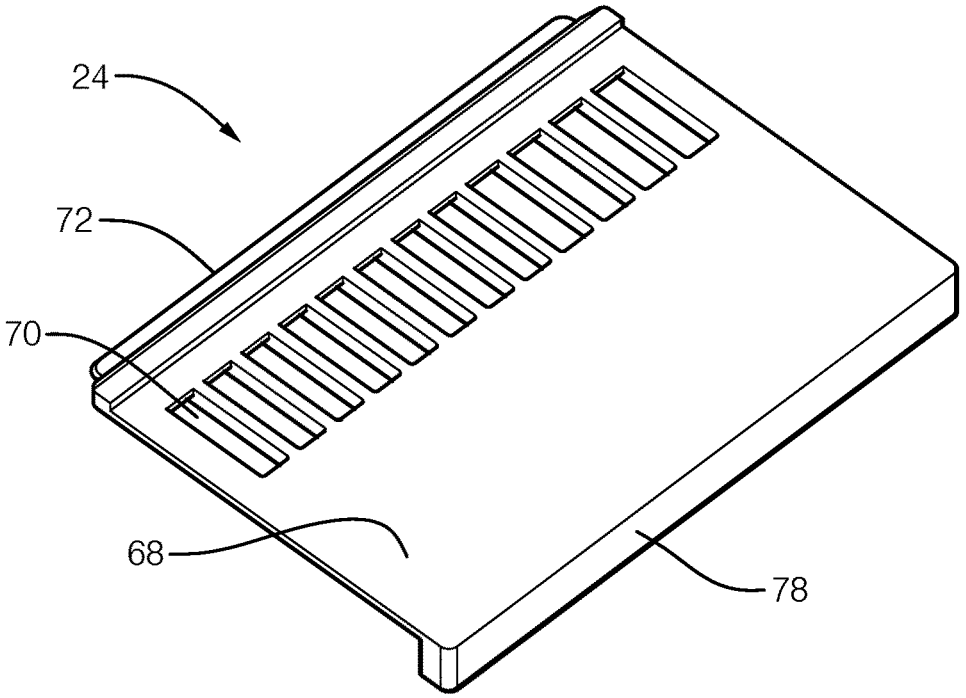
FIG. 7B is a perspective bottom view of stiffening member of the flat cable of FIG. 5 according to one embodiment of the invention.

Focusing now on the flat cable 18 as illustrated in FIG. 5, the flat cable 18 includes a flexible substrate 64 including the flat first conductive traces, e.g. thin copper strips, encased within an insulative material, such as polyethylene terephthalate (PET). Such a flat cable 18 is typically referred to as a flexible flat cable 18 (FFC) or flexible printed circuit (FPC). As shown in FIG. 5, the width of the first conductive traces may be varied to provide different electrical characteristics, e.g. resistance or current capacity. The insulative material is removed from at least one end of the flat cable 18 to expose the first conductive traces, thereby providing the first contact regions 22.

The flat cable 18 also includes a stiffening member 24 that is attached to an end of the flat cable 18 on a side of the flat cable 18 located opposite the first contact regions 22. The stiffening member 24 may be attached to the flat cable 18 using a pressure bond adhesive (not shown), such as VHB™ double sided adhesive tape manufactured by the 3M Corporation of Minneapolis, Minn. The stiffening member 24 is formed of a dielectric material, such as PA or PBT and includes a planar body portion 68 and a plurality of openings 70 extending through the body portion and configured to allow contact on the surface of the flat cable 18 opposite the first contact regions 22 by the bottom spring members 46.

Figure 13:
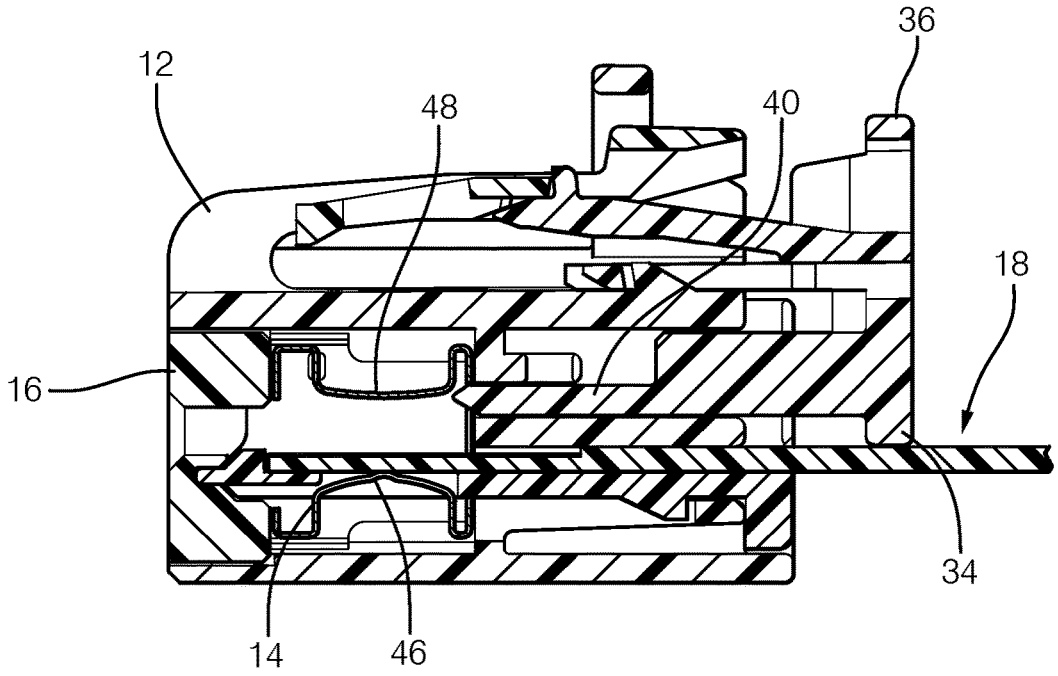
FIG. 13 is a side cross section view of the assembly of FIG. 9 with the connector position assurance device assembled to the electrical connector of FIG. 1 and in a pre-staged position according to one embodiment of the invention.
Figure 14:
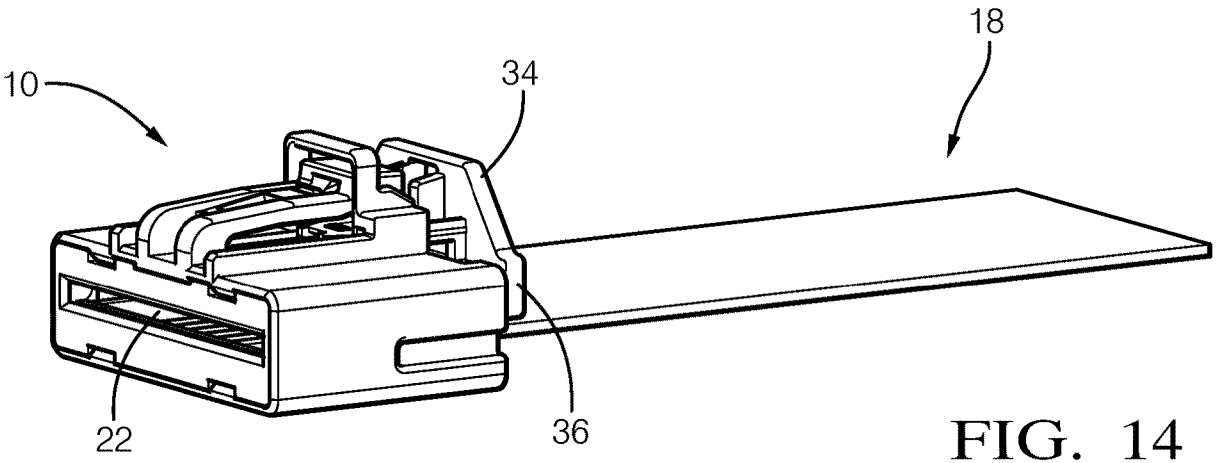
FIG. 14 is a perspective view of the assembly of FIG. 13 according to one embodiment of the invention.

The stiffening member 24 includes an angled lip 72 on a forward edge of the stiffening member 24 that has a maximum height that is at least equal to a thickness of the flat cable 18. This angled lip 72 is configured to protect the flat cable 18 as the flat cable 18 and stiffening member 24 are inserted within the cavity 42 and spring array 14. The stiffening member 24 additionally includes a locking latch 74 configured to engage a strike surface 76 within the cavity 42 of the housing 12. Without subscribing to any particular theory of operation, as the stiffening member 24 is inserted within the cavity 42, the angled forward edge of the locking latch 74 causes the planar body to bend upwardly until the rearward edge of the locking latch 74 clears the strike surface 76 and planar body returns to its planar form, thereby engaging the rearward edge of the locking latch 74 with the strike surface 76. The locking latch 74 and strike surface 76 cooperate to retain the stiffening member 24 within the housing 12. A rearward edge stiffening member 24 of the stiffening member 24 defines a ridge 78 that is configured to contact a rearward surface 80 of the housing 12 of the electrical connector 10, thereby positioning the stiffening member 24 within the housing 12. As best shown in FIG. 13, the locking latch 74, the ridge 78, and the retainer 16 cooperate to position the first contact regions 22 within the connector 10.

Figure 18:
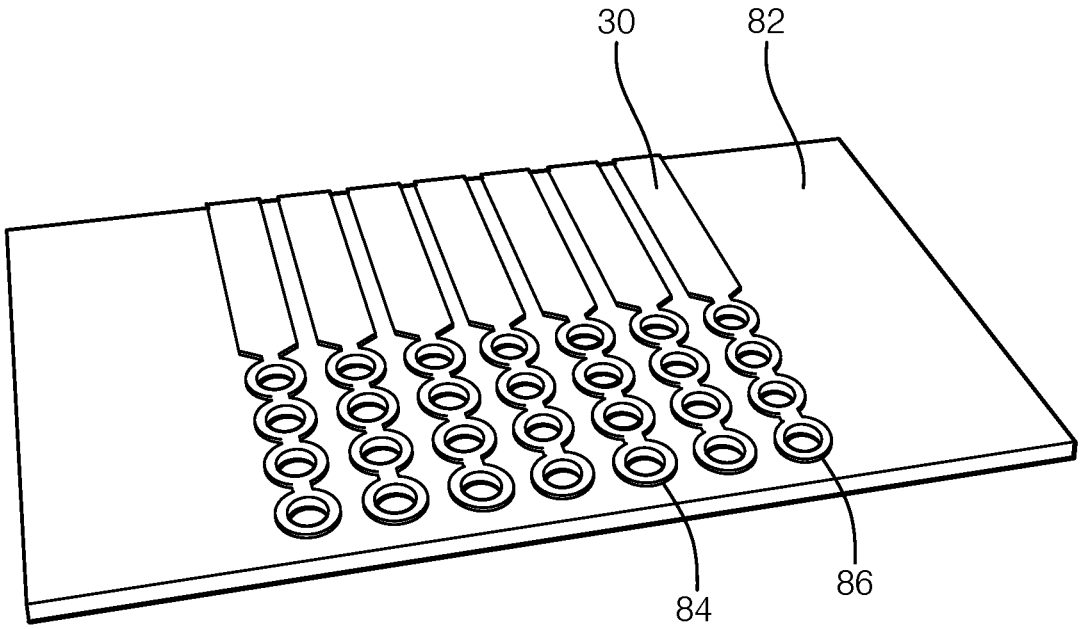
FIG. 18 is an isolated view of a contact region of the printed circuit board of FIG. 15 according to one embodiment of the invention.
Figure 19:
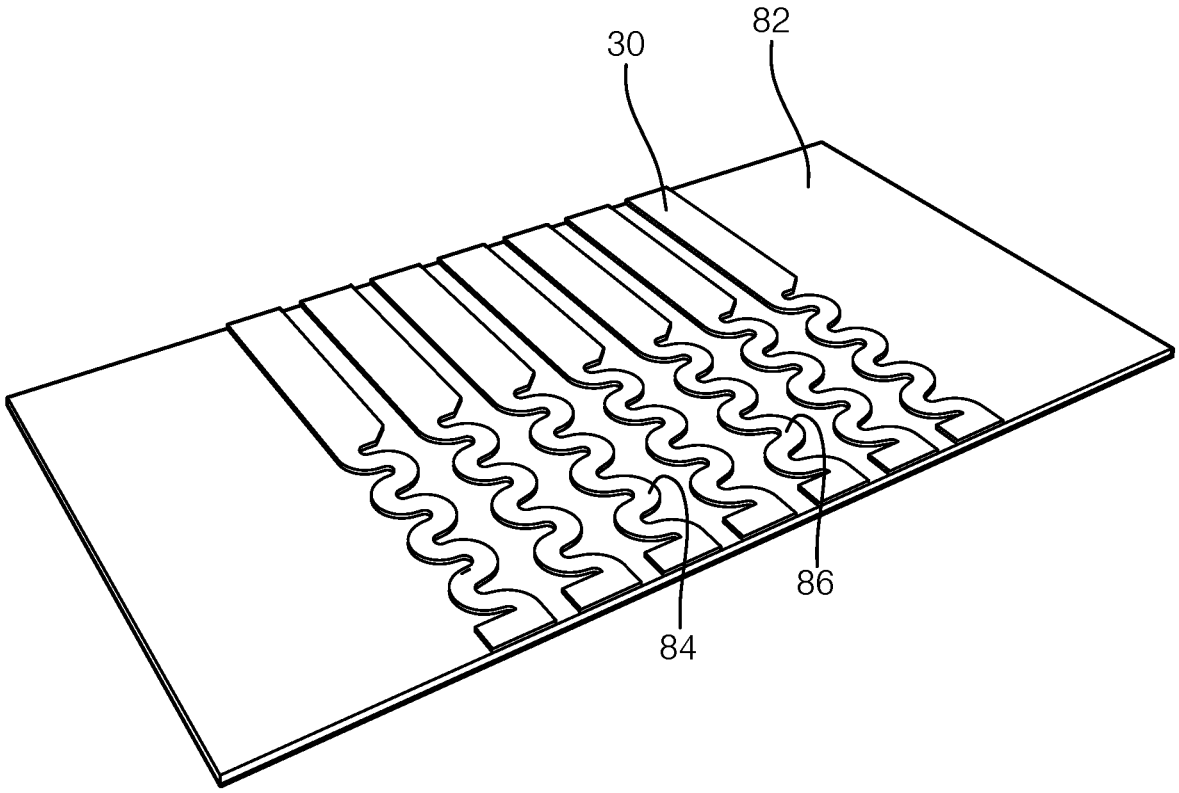
FIG. 19 is an isolated view of a contact region of the printed circuit board of FIG. 15 according to another embodiment of the invention.

Focusing now on the PCB 28 as shown in FIGS. 18 and 19, the PCB 28 includes a circuit board substrate 82 and the plurality of second conductive traces 30 disposed thereon. Exposed ends of the second conductive traces 30 define the second contact regions 32. The second contact regions 32 define a plurality of ridges 84 protruding from a circuit board substrate surface that are configured to concentrate stress on the first contact regions 22. Without subscribing to any particular theory of operation, these stress concentrations increase reliability and current carrying capacity of the connection between the first contact regions 22 and the second contact regions 32.

The PCB 28 may use a circuit board substrate 82 that is formed of epoxy or polyimide resins. The resin may be reinforced with a woven glass cloth or other matrix such as chopped fibers. Substrates formed of such materials are typically referred to as FR-4 or G-10 type circuit boards. The PCB 28 may alternatively be constructed of ceramic or rigid polymer materials. This listing of acceptable substrate materials is not exhaustive and other materials may also be used successfully. A layer of conductive material, such as a copper based material is electroplated on at least one major surface of the PCB 28. The layer of conductive material is then formed to create the second conductive traces 30 and second contact regions 32 typically by using a chemical etching process.

In some embodiments of the invention, the plurality of ridges 84 is formed on outer edges of a plurality of plated through holes or vias 86 in the second contact region 32 as shown in FIG. 18. Each of the second contact regions 32 may include a number of interconnected vias 86 arranged linearly.

Each via 86 consists of two pads in corresponding positions on different layers of the substrate 82 that are electrically connected by a hole through the board. The hole is made conductive by electroplating. The electroplating is thickest on the outside edge of the pad and is tapered in thickness as it approaches the hole, thereby forming an "inverted volcano" shape. The pad on one or both sides of the PCB 28 is connected to the second conductive traces 30 on the surface of the PCB 28. The second conductive traces 30 interconnect each of the second contact regions 32 to electrical components on the PCB 28. The materials and manufacturing techniques used to the form PCBs and vias are well known to those skilled in the art.

In other embodiments of the invention, the plurality of ridges 84 is formed by a serpentine pattern 88 in the second conductive traces 30 within the second contact region 32 as shown in FIG. 19.

The printed circuit board also includes the mating connector 26 which defines a shroud 90 surrounding the second contact region 32 that is configured to receive a forward portion of the housing 12 of the connector 10. The connector 10 and the mating connector 26 cooperate to align the first contact regions 22 with the second contact regions 32.

While the examples of the connector 10 described herein is configured to connect a flat cable 18 with a PCB 28, other embodiments of the connector may be envisioned in which the connector is configured to interconnect one flat cable with another flat cable to make an in-line connection.

Additionally, while the connector 10 described herein is configured to connect a single flat cable 18 with a pcb 28, other embodiments of the connector may be envisioned in which the connector is configured to interconnect two flat cables with the PCB; one flat cable connected to each side of the PCB.

Further, while the connector 10 described herein includes an actuating member 40 that is integrated with a CPA device 34. Other embodiments of the invention may be envisioned in which the actuating member is implemented without a CPA device.

Accordingly, an electrical connector 10 is presented. The connector provides a zero insertion force (ZIF) connection between a flat cable 18 and a PCB 28, another flat cable, or any other flat substrate having suitably aligned contact regions while providing a high contact force after the actuating member 40 moved to the staged position 38. The connector 10 also provides reduced wiping forces between the first and second contact regions 22, 32 as the connector 10 and the mating connector 26 are attached to one another. The thickness of the actuating member 40 may be adjusted to accommodate different thicknesses of the flat cable(s), PCB, or other substrate without having to make changes to the housing 12, retainer 16, or the spring array 14 of the connector 10. The actuating member 40 and the spring array 14 cooperate to beneficially provide a uniform compressive contact pressure on each pair of first and second contact regions 22, 32. Additionally, the ridges 84 formed in the second contact regions 32 create stress concentrations that increase the reliability and current carrying capacity of the connection between the first contact regions 22 and the second contact regions 32.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector, comprising:

a housing configured to receive a planar first substrate including an electrically conductive first circuit trace having a first contact region and further configured to receive a planar second substrate including an electrically conductive second circuit trace having a second contact region, wherein the housing is configured to align the first contact region with the second contact region; and a force application device configured to apply a compressive contact force to the first and second substrates, thereby putting the first contact region in intimate compressive contact with the second contact region, wherein the compressive contact force comprises a first compressive contact force and a second compressive contact force in opposition to the first compressive contact force and wherein the force application device comprises:

a first spring member configured to apply the first compressive contact force to the first substrate, and a second spring member configured to apply the second compressive contact force to the second substrate, wherein the first spring member is an arcuate first fixed beam having a first radius of curvature and the second spring member is an arcuate second fixed beam having a second radius of curvature and wherein the first radius of curvature is less than the second radius of curvature.

2. The electrical connector according to claim 1, further comprising:

an actuating member configured to increase the compressive contact force applied to the first and second substrates via interaction with the force application device, the actuating member is moveable from a pre-staged position in which the actuating member does not increase the compressive contact force to a staged position in which the actuating member increases the compressive contact force.

3. The electrical connector according to claim 2, wherein the actuating member is sized such that the increase in the compressive contact force is within a predetermined range regardless of an overall thickness of the first substrate and the second substrate.

4. The electrical connector according to claim 1, wherein the compressive contact force is provided only by the force application device.

5. The electrical connector according to claim 1, wherein the force application device is disposed within the housing.

6. The electrical connector according to claim 1, wherein the force application device has an open box-like structure that is configured to surround the first substrate and the second substrate.

7. The electrical connector according to claim 1, wherein the force application device is formed of a metallic material and the housing is formed of a polymeric material.

8. The electrical connector according to claim 1, further comprising:

an actuating member that is moveable from a pre-staged position in which the actuating member is not located intermediate the first spring member and the second spring member to a staged position in which the actuating member is located intermediate the first spring member and the second spring member.

9. The electrical connector according to claim 8, wherein the actuating member is integral with a connector position assurance device that is configured to allow movement of the actuating member from the pre-staged position to the staged position when the housing is received within and fully mated with a corresponding mating connector.

10. The electrical connector according to claim 8, wherein the actuating member is sized such that the second compressive contact force is within a predetermined range regardless of an overall thickness of the first substrate and the second substrate.

11. The electrical connector according to claim 1, wherein the second spring member is located opposite the first spring member.

12. The electrical connector according to claim 1, wherein the first spring member and the second spring member are integrally formed within the force application device.

13. An electrical connector, comprising:

a housing configured to receive a planar first substrate including an electrically conductive first circuit trace having a first contact region and further configured to receive a planar second substrate including an electrically conductive second circuit trace having a second contact region, wherein the first substrate is formed of a flexible material and wherein the housing is configured to align the first contact region with the second contact region;

a force application device configured to apply a compressive contact force to the first and second substrates, thereby putting the first contact region in intimate compressive contact with the second contact region, wherein the compressive contact force comprises a first compressive contact force and a second compressive contact force in opposition to the first compressive contact force and wherein the force application device comprises:

a first spring member configured to apply the first compressive contact force to the first substrate, and a second spring member configured to apply the second compressive contact force to the second substrate; and a planar stiffening member attached to a surface of the first substrate located opposite the first contact region, wherein the stiffening member defines an opening through the stiffening member in which the first spring member is received and through which the first spring member makes contact with the surface of the first substrate located opposite the first contact region.

14. An electrical connector, comprising:

a housing configured to receive a planar first substrate including an electrically conductive first circuit trace having a first contact region and further configured to receive a planar second substrate including an electrically conductive second circuit trace having a second contact region, wherein the first substrate is formed of a flexible material and wherein the housing is configured to align the first contact region with the second contact region;

a force application device configured to apply a compressive contact force to the first and second substrates, thereby putting the first contact region in intimate compressive contact with the second contact region, wherein the compressive contact force comprises a first compressive contact force and a second compressive contact force in opposition to the first compressive contact force and wherein the force application device comprises:

a first spring member configured to apply the first compressive contact force to the first substrate, and a second spring member configured to apply the second compressive contact force to the second substrate; and a planar stiffening member attached to a surface of the first substrate located opposite the first contact region, wherein the stiffening member is disposed within and is attached to the housing by a latching mechanism, and wherein a rearward edge of the stiffening member defines a ridge configured to contact the housing and positions the first contact region within the housing.

15. An electrical connector, comprising:

a housing configured to receive a planar first substrate including an electrically conductive first circuit trace having a first contact region and further configured to receive a planar second substrate including an electrically conductive second circuit trace having a second contact region, wherein the first substrate is formed of a flexible material and wherein the housing is configured to align the first contact region with the second contact region;

a force application device configured to apply a compressive contact force to the first and second substrates, thereby putting the first contact region in intimate compressive contact with the second contact region, wherein the compressive contact force comprises a first compressive contact force and a second compressive contact force in opposition to the first compressive contact force and wherein the force application device comprises:

a first spring member configured to apply the first compressive contact force to the first substrate, and a second spring member configured to apply the second compressive contact force to the second substrate; and a planar stiffening member attached to a surface of the first substrate located opposite the first contact region, wherein a forward edge of the stiffening member defines an angled lip having a maximum height at least equal to a thickness of the first substrate.

16. An electrical connector, comprising:

a housing configured to receive a planar first substrate including an electrically conductive first circuit trace having a first contact region in a cavity defined within the housing and further configured to receive a planar second substrate including an electrically conductive second circuit trace having a second contact region in the cavity, wherein the first contact region is configured to be aligned with the second contact region; and a force application device comprising a first spring member configured to apply a first compressive contact force to the first substrate and a second spring member configured to apply the second compressive contact force to the second substrate, thereby putting the first contact region in intimate compressive contact with the second contact region, wherein the first spring member is an arcuate first fixed beam having a first radius of curvature and the second spring member is an arcuate second fixed beam having a second radius of curvature and wherein the first radius of curvature is less than the second radius of curvature.

17. The electrical connector according to claim 16, further comprising:

an actuating member configured to increase the second compressive contact force applied to the first and second substrates via interaction with the second spring member, wherein the actuating member is configured to be moveable from a pre-staged position in which the actuating member is not located intermediate the first spring member and the first substrate to a staged position in which in which the actuating member is located intermediate the first spring member and the second spring member, thereby applying the first compressive contact force to the first substrate.

18. The electrical connector according to claim 17, wherein the actuating member is configured to increase the second compressive contact force applied by the second spring member to the second substrate when the actuating member is in the staged position.

19. The electrical connector according to claim 17, wherein the actuating member is sized such that the second compressive contact force applied to the second substrate is within a first predetermined range regardless of an overall thickness of the first substrate and the second substrate.

20. The electrical connector according to claim 19, wherein the actuating member is sized such that the first compressive contact force applied to the first substrate is within a second predetermined range when the actuating member is in the staged position regardless of the overall thickness of the first substrate and the second substrate.

21. The electrical connector according to claim 17, wherein the actuating member is integral with a connector position assurance device that is configured to allow movement of the actuating member from the pre-staged position to the staged position when the housing is received within and fully mated with a corresponding mating connector.

22. The electrical connector according to claim 16, wherein the first and second compressive contact forces are provided only by the force application device.

23. The electrical connector according to claim 16, wherein the force application device is disposed within the housing.

24. The electrical connector according to claim 16, wherein the force application device has an open box-like structure that is configured to surround the first substrate and the second substrate.

25. The electrical connector according to claim 16, wherein the force application device is formed of a metallic material and the housing is formed of a polymeric material.

26. The electrical connector according to claim 16, wherein the second spring member is located opposite the first spring member.

27. The electrical connector according to claim 16, wherein the first spring member and the second spring member are integrally formed within the force application device.

28. An electrical connector, comprising:

a housing configured receive a planar first substrate including an electrically conductive first circuit trace having a first contact region in a cavity defined within the housing and further configured to receive a planar second substrate including an electrically conductive second circuit trace having a second contact region in the cavity, wherein the first substrate is formed of a flexible material and wherein the first contact region is configured to be aligned with the second contact region;

a force application device comprising a first spring member configured to apply a first compressive contact force to the first substrate and a second spring member configured to apply the second compressive contact force to the second substrate, thereby putting the first contact region in intimate compressive contact with the second contact region; and a planar stiffening member attached to a surface of the first substrate located opposite the first contact region, wherein the stiffening member defines an opening through the stiffening member in which the first spring member is received and through which the first spring member makes contact with the surface of the first substrate located opposite the first contact region.

29. The electrical connector according to claim 28, wherein the stiffening member is disposed within and is attached to the housing by a latching mechanism.

30. An electrical connector, comprising:

a housing configured to receive a planar first substrate including an electrically conductive first circuit trace having a first contact region in a cavity defined within the housing and further configured to receive a planar second substrate including an electrically conductive second circuit trace having a second contact region in the cavity, wherein the first substrate is formed of a flexible material and wherein the first contact region is configured to be aligned with the second contact region;

a force application device comprising a first spring member configured to apply a first compressive contact force to the first substrate and a second spring member configured to apply the second compressive contact force to the second substrate, thereby putting the first contact region in intimate compressive contact with the second contact region; and a planar stiffening member attached to a surface of the first substrate located opposite the first contact region, wherein the stiffening member is disposed within and is attached to the housing by a latching mechanism, wherein a rearward edge of the stiffening member defines a ridge configured to contact the housing and positions the first contact region within the housing.

31. An electrical connector, comprising:

a housing configured to receive a planar first substrate including an electrically conductive first circuit trace having a first contact region in a cavity defined within the housing and further configured to receive a planar second substrate including an electrically conductive second circuit trace having a second contact region in the cavity, wherein the first substrate is formed of a flexible material and wherein the first contact region is configured to be aligned with the second contact region;

a force application device comprising a first spring member configured to apply a first compressive contact force to the first substrate and a second spring member configured to apply the second compressive contact force to the second substrate, thereby putting the first contact region in intimate compressive contact with the second contact region; and a planar stiffening member attached to a surface of the first substrate located opposite the first contact region, wherein a forward edge of the stiffening member defines an angled lip having a maximum height at least equal to a thickness of the first substrate.

32. A stiffening member configured for attachment to flat flexible electrical cable formed of a flexible planar substrate including an electrically conductive circuit trace having a contact region, said stiffening member comprising:

a planar body portion;

an opening through the body portion configured to allow access to a surface of the substrate opposite the contact region, wherein the stiffening member is configured to be disposed within and is attached to a housing of an electrical connector; and a locking latch configured to engage a strike surface within the housing and retain the stiffening member within the housing.

33. The stiffening member according to claim 32, further comprising:

an angled lip on a forward edge of the stiffening member having a maximum height at least equal to a thickness of the substrate.

34. The stiffening member according to claim 32, wherein a rearward edge of the stiffening member defines a ridge configured to contact a rearward surface of the housing of the electrical connector, thereby positioning the contact region within the housing.

* * * * *